United States Patent [19]

Orscheln et al.

[11] 4,178,491

[45] Dec. 11, 1979

[54] SWITCH ACTUATOR MEANS OF THE TIME DELAY TYPE

[75] Inventors: Don W. Orscheln; Robert D. Bopp, both of Moberly, Mo.

[73] Assignee: Orscheln Brake Lever Mfg. Co., Moberly, Mo.

[21] Appl. No.: 840,373

[22] Filed: Oct. 7, 1977

[51] Int. Cl.[2] ..... H01H 43/00

[52] U.S. Cl. ..... 200/34

[58] Field of Search ..... 200/34, 17 R, 329, 38 D; 267/113, 114

[56] References Cited

U.S. PATENT DOCUMENTS

| | | | |
|---|---|---|---|
| 716,406 | 12/1902 | Gibbings | 200/17 R |
| 2,035,648 | 3/1936 | Frank | 200/34 |
| 2,590,840 | 4/1952 | Clayton | 200/34 |
| 2,637,788 | 5/1953 | Bracken | 200/34 |
| 3,179,758 | 4/1965 | Trock | 200/38 D |
| 3,484,090 | 12/1969 | Mahoney | 200/34 X |

FOREIGN PATENT DOCUMENTS

| | | | |
|---|---|---|---|
| 12204 | 11/1908 | Denmark | 200/34 |
| 577177 | 5/1924 | France | 200/34 |
| Ad. 30622 | 4/1926 | France | 200/34 |
| 306574 | 2/1929 | United Kingdom | 200/34 |

*Primary Examiner*—James R. Scott

*Attorney, Agent, or Firm*—Lawrence E. Laubscher

[57] ABSTRACT

A switch actuator of the time-delay type is disclosed for operating an electrical switch having an ON-OFF lever, including a mounting plate upon which is secured a cylinder closed at one end and open at the other end to the atmosphere. A piston is slidably disposed within the cylinder and includes a one-way seal member which defines at the closed end of the cylinder a substantially fluid-tight chamber. The piston, which is normally spring-biased toward the open end of the cylinder, is displaceable against the force of the spring toward a first position adjacent the closed end of the cylinder, thereby to force the fluid quickly out of the sealed chamber past the one-way seal. An operating member movably connected with the switch plate pivots the switch lever to the ON position when the piston is in the first position. The seal member is designed to permit controlled leakage of atmospheric fluid back into the chamber, whereby the spring-biased piston is displaced at a predetermined controlled rate toward a second position adjacent the open end of the piston, whereupon the operating member is operated to displace the switch lever toward the OFF position. A decorative cover member is connected with the switch plate by a snap connection to enclose the time delay device.

6 Claims, 9 Drawing Figures

Fig. 1
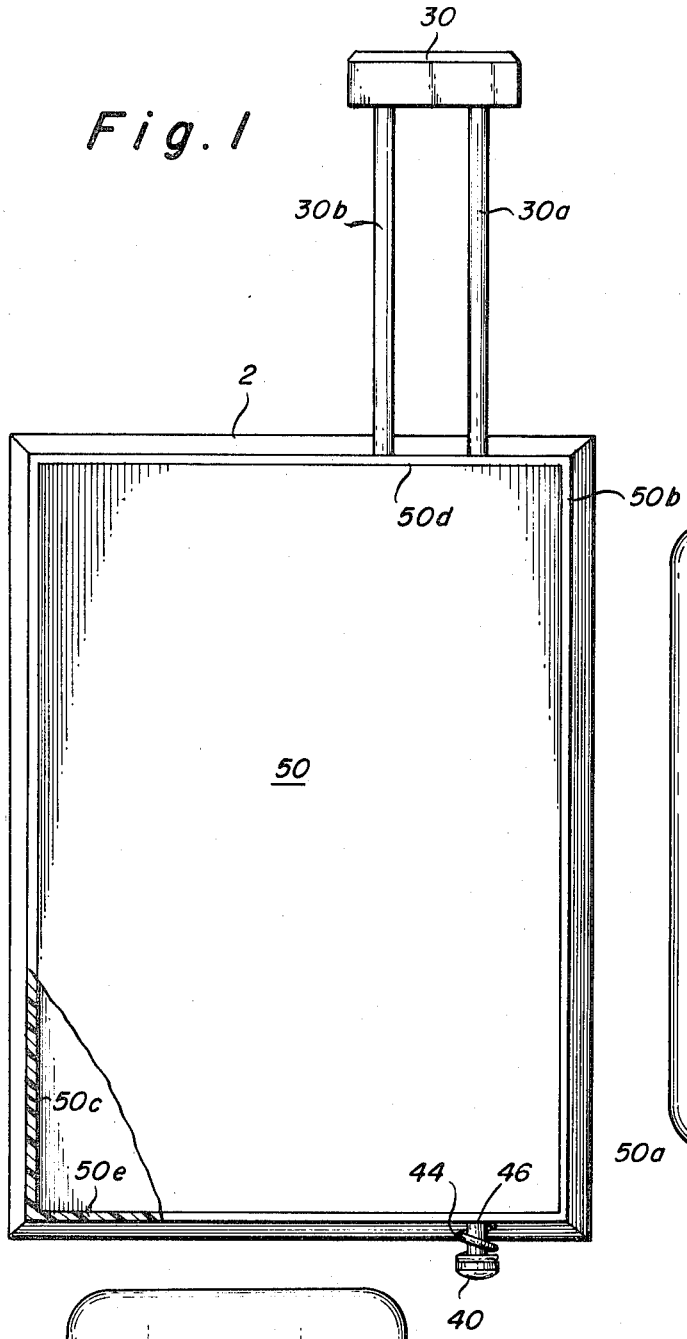
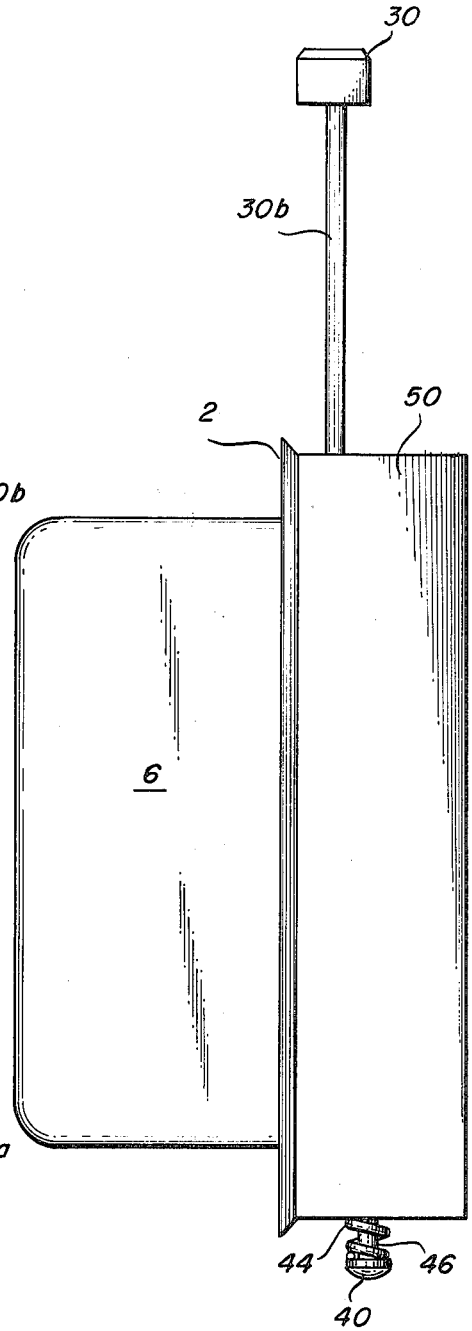
Fig. 3
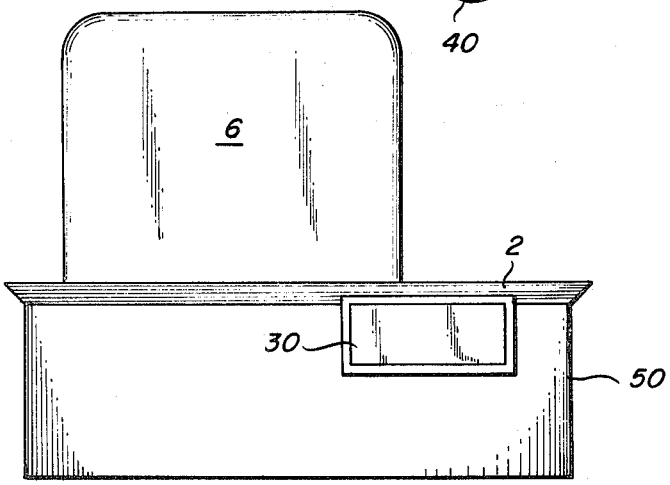
Fig. 2

Fig. 4
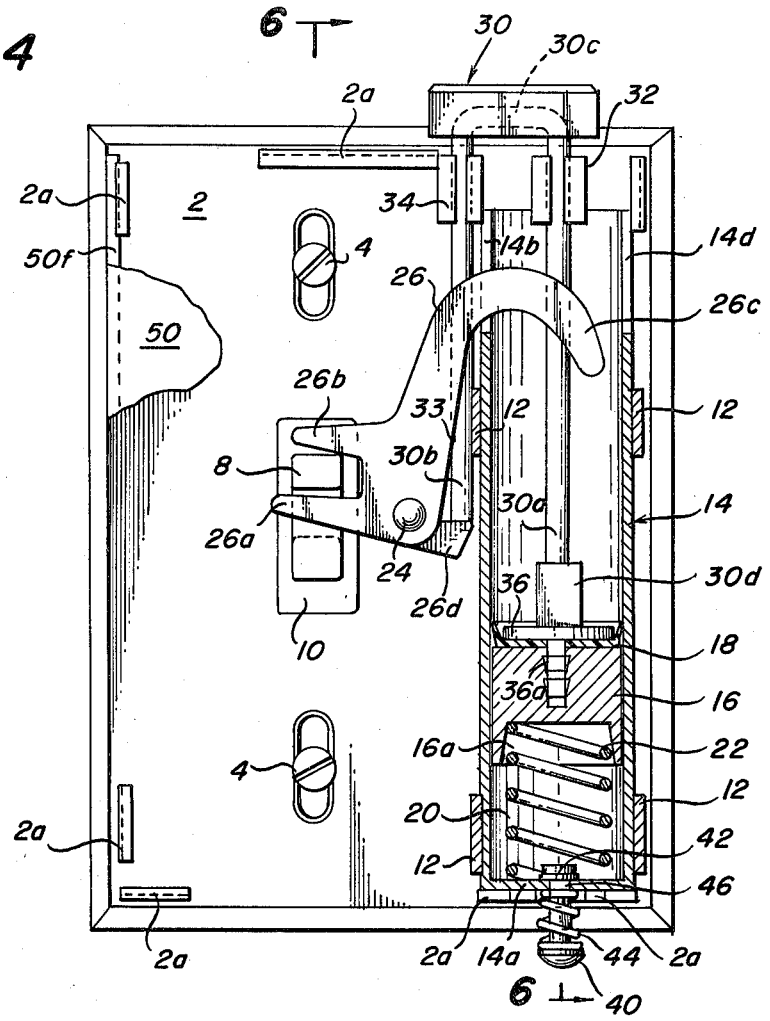
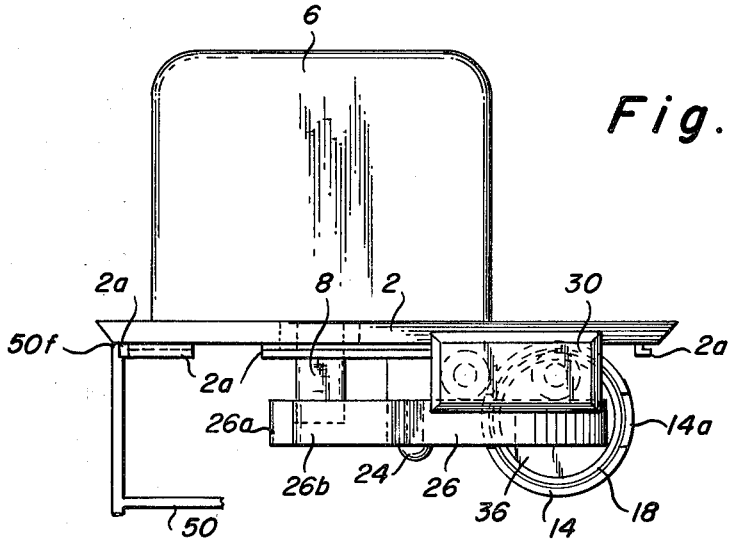
Fig. 5

SWITCH ACTUATOR MEANS OF THE TIME DELAY TYPE

FIELD OF THE INVENTION

The present invention relates generally to time-delay actuator means for use in conjunction with an electrical switch in order to control the positioning of the switch lever to either its ON or OFF positions. The electrical switches may be of the toggle, semi-silent mercury type.

BACKGROUND OF THE INVENTION

Various different types of time-delay actuators are known for controlling electrical switches of the type conventionally employed in, for example, residential lighting circuits in order to extinguish the lights at a predetermined time. Examples of such known time-delay devices are presented in the prior U.S. patents to Bracken U.S. Pat. No. 3,179,396, Koch U.S. Pat. No. 3,739,112, Trock U.S. Pat. No. 3,179,758, Keefe U.S. Pat. No. 3,178,947, Mudon U.S. Pat. No. 2,394,712, Halicho U.S. Pat. No. 3,584,166 and Laviana et al. U.S. Pat. No. 2,937,247, among others. Most of the actuator devices conventionally employed in such environments, however, are quite costly to manufacture and have proven operatively impractical. These results are due to the fact that the devices are normally structurally complex and comprise a substantial number of operative components, including, for example, electrically-driven or spring-operated timing mechanisms. In utilizing such devices, various levers and timing dials must be initially activated and preset in order to properly determine the time-delay period.

It has been demonstrated that people will normally not readily operate such devices in order to simply assure the fact that lights within a particular room or area of the residence will be turned off after they have been initially turned on. Consequently, with respect to those devices wherein the time-delay actuator is, in effect, integrally connected to the switch mechanism, operation of the actuator mechanism, in order to operate the switch mechanism, becomes bothersome. Alternatively, with respect to those devices wherein the time-delay actuator is not, in effect, integrally connected to the switch mechanism, the actuator mechanism is simply not utilized, except possibly under special circumstances, as the time-delay setting operation thereof is too troublesome. In such instances, therefore, the lights continue to be illuminated with a consequent waste of electrical energy and unnecessary expenditure by the consumer in the form of excessive utility bills.

In the aforementioned Bracken U.S. Pat. No. 3,179,396, the time delay actuating mechanism is not always operatively connected with the toggle switch lever. Consequently, in those instances wherein, for example, it is desired to assure the fact that lights will be extinguished at a predetermined time subsequent to their illumination, unless the light switch operator remembers to set the actuating mechanism, it is likely that the lights will continue to be illuminated for excessively long periods of time. This situation often occurs within those areas of the residence where children play or spend considerable amounts of time. Children often fail to remember to extinguish lights after leaving a play area, and it may readily be appreciated that this problem will not be resolved by employing an actuating mechanism as disclosed within the aforenoted patent as the children will often be just as likely as not to forget to set the actuating mechanism of such a toggle-switch system.

SUMMARY OF THE INVENTION

Accordingly, it is an object of the present invention to provide a new and improved time-delay switch actuating mechanism including a switch plate adapted for mounting on the face of the switch box, said switch plate containing an aperture through which the ON-OFF switch lever projects, a cylinder secured to the switch plate, said cylinder being closed at one end and open to atmosphere at its other end, a piston mounted for reciprocation in said cylinder, said piston being spring-biased toward the open end of the cylinder, and one-way seal means connected with said piston for defining a substantially fluid-tight chamber adjacent the closed end of the cylinder. In accordance with a characterizing feature of the invention, when the piston is displaced by activating means toward a first position adjacent the closed end of the cylinder, the one-way seal means is operable to quickly discharge fluid from the chamber. The seal means then gradually leaks atmospheric fluid back into the chamber at a predetermined rate, whereupon the piston is gradually displaced by the spring-biasing means toward a second position adjacent the open end of the cylinder. Switch lever operating means are pivotally connected with the face plate for pivoting the switch lever between its ON and OFF positions when the piston is in its first and second positions, respectively.

Accordingly to a more specific object of the invention, slot means may be provided in the free end of the cylinder, whereby when the piston is in an intermediate position adjacent the free end of the cylinder, the chamber is vented, thereby to permit the piston to be rapidly displaced by the spring means toward its second position. This feature is particularly important when the time-delay actuator means is used in conjunction with an electrical switch of the toggle type.

In accordance with another object of the invention, manually operable bleed valve means may be provided for venting the chamber to atmosphere when the piston is in its first position or an intermediate position, whereupon the piston is rapidly displaced to its second position by the spring biasing means, the delay operation of the actuator means being rendered inoperable.

According to a more specific object of the invention, the activating means for displacing the piston to its first position and for simultaneously pivoting the switch lever operating member to cause the lever to be in the ON position comprises a rod assembly slidably connected with the face plate and including a pair of parallel rod portions one of which extends through the open end of the cylinder for abutting engagement with the piston, and the other of which engages a projection on the switch lever operating member. The operating member, which has at one end a bifurcated portion defining a pair of arms through which the switch lever extends, is provided at its other end with an extension that is engaged by the piston when in the second position, thereby to pivot the operating member to a position causing displacement of the switch lever to its OFF position. By varying the length of the actuating rod, the time delay interval of the apparatus may be varied accordingly.

BRIEF DESCRIPTION OF THE FIGURES

Other objects and advantages of the invention will become apparent from a study of the following specification when viewed in the light of the accompanying drawing, in which:

FIGS. 1-3 are front elevation, top plan, and side elevation views, respectively, of the time delay actuator means of the present invention mounted on a conventional toggle switch device with the cover member in place and with the mechanism in the "off" position;

FIG. 4 is a partly-sectioned front elevation view of the time-delay actuator means of FIG. 1 with the cover member removed and with the mechanism in the "switch on" position;

FIG. 5 is a plan view of the apparatus of FIG. 4;

DETAILED DESCRIPTION

Figure 6:
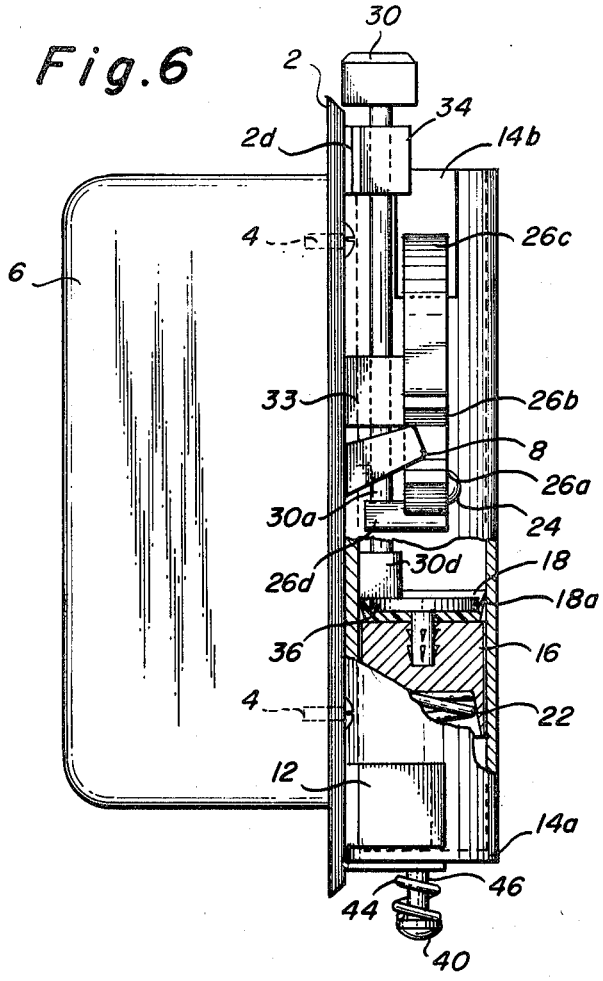
FIG. 6 is a sectional view taken along line 6—6 of FIG. 4.

Referring first more particularly to FIGS. 1-5, the actuator means of the present invention include a switch plate 2 that is adapted to be secured by screws 4 to the face of a conventional switch box 6, which, in the illustrated embodiment, is of the toggle type including a switch lever 8 that extends through an aperture 10 contained in the switch plate and is pivotable from the illustrated ON position to an OFF position, as is conventional in the art. Secured to the switch plate 2 by clips 12 is a vertically arranged hollow cylinder 14 the bottom end of which is closed by the bottom wall 14*a* and the top end of which is open to atmosphere.

Mounted for vertical sliding movement in the cylinder 14 is a piston 16 to the upper end of which is secured a one-way seal 18 having an annular lip portion 18*a* that is in relatively fluid-tight engagement with the inner wall surface of the cylinder 14, thereby to define in the bottom of the cylinder adjacent the closed bottom wall 14*a* a closed chamber 20. Mounted in the chamber 20 beneath the piston 16 is a compression spring 22 that normally biases the piston upwardly in the cylinder 14. The upper end of the spring 22 extends within a corresponding recess 16*a* formed in the bottom of the piston 16, and the lower end of the spring 22 abuts the bottom wall 14*a* of the cylinder.

Pivotally connected with the switch plate 2 by pivot axis 24 arranged normal thereto is a switch lever operating member 26 which is of the bell crank type, one end of which is bifurcated to define the arm portions 26*a* and 26*b* that extend on opposite sides of the switch lever 8. The other end 26*c* of the operating member extends via an axial slot 14*b* contained in the upper end of the cylinder 14 for engagement by the piston 16 as will be described in greater detail below. The operating member 26 is also provided with a projection 26*d* adjacent the pivot shaft 24.

Activating means including a rod assembly 30 connected for vertical sliding movement relative to the switch plate 2 are provided for displacing the piston 16 downwardly toward the illustrated first position, and for simultaneously pivoting the operating member 26 in the clockwise direction to pivot the switch lever 8 upwardly to its illustrated ON position. More particularly, the rod assembly 30 includes a pair of parallel rod portions 30*a* and 30*b* that are vertically slidably guided by the guide means 32 and 34, respectively, on the switch plate 2. The rod portion 30*a* extends downwardly through the upper end of the cylinder 14, the enlarged lower extremity 30*d* of the rod portion being in abutting engagement with an annular button fastener 36 which presses the central portion of the seal element 18 against the upper end of the piston 16. The other rod portion 30*b* extends downwardly through the guide means 33 and 34 externally of the cylinder 14 for engagement with the projection 26*d* on the switch lever operating member 26. The rod portions 30*a* and 30*b* are connected at their upper ends with the integral bridging portion 30*c*.

Manually operable bleed valve means 40 are provided for venting to atmosphere the bottom portion of the closed chamber 20, said bleed valve means including a valve member 42 that is biased downwardly toward its closed position by the compression spring 44.

Figure 7:
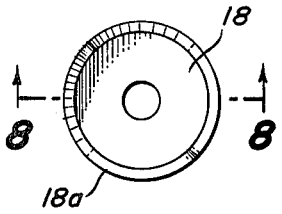
FIG. 7 is a plan view of the seal means of the present invention.
Figure 8:
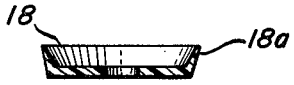
FIG. 8 is a sectional view taken along line 8—8 of FIG. 7.
Figure 9:
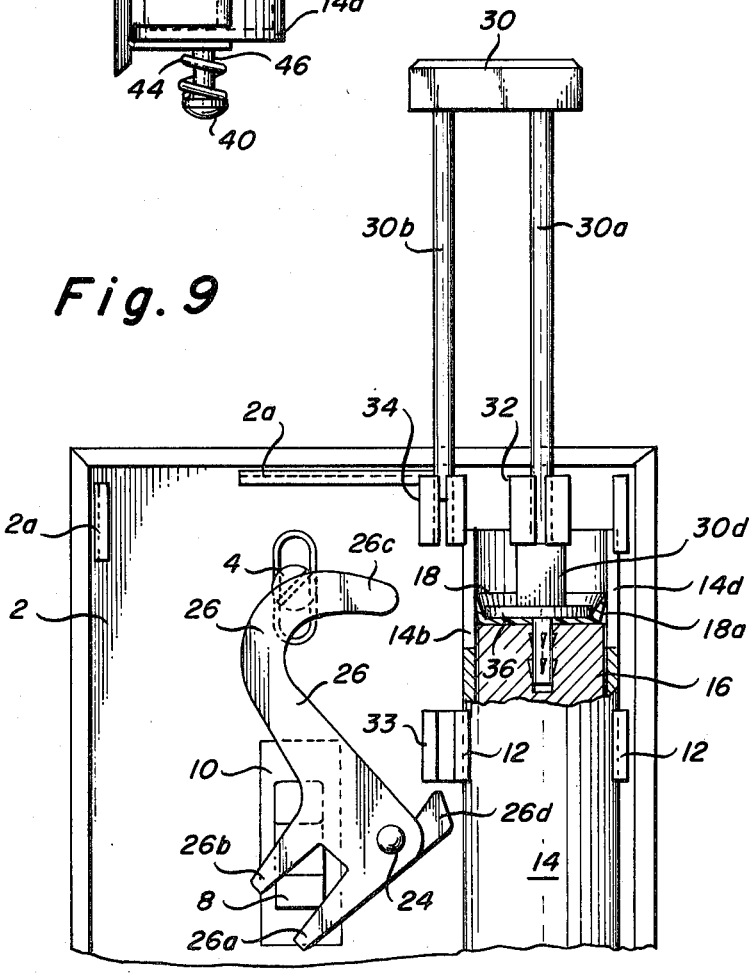
FIG. 9 is a detailed partly-sectioned view illustrating the apparatus of FIG. 4 in the "switch off" position.

As shown in FIGS. 7 and 8, the seal member 18 is preferably formed of a synthetic plastic material having a low coefficient of friction, such as teflon, polyethylene or the like. The seal 18 has an upwardly directed annular lip portion 18*a* that extends slightly radially outwardly for one-way dynamic sealing with the inner surface of the cylinder 14. The cylinder 14 may be formed of a suitable metallic material, such as aluminum, or a synthetic plastic material, such as lexan. If desired, the lip portion of the seal may be slightly lubricated with a light machine oil. The seal 18 is provided with a central aperture 18*b* through which the shank portion 36*a* of the button 36 extends for connection with the piston 16. While the shank portion 36*a* of the button member 36 has been illustrated as being connected with the piston 16 by force-fit fastener means 30*d*, it is apparent that the piston could be connected with the shank portion of the button 36 by conventional screw thread means.

A snap-fit cover member 50 is provided for enclosing the actuator mechanism, said cover member including a front wall 50*a*, opposed side walls 50*b* and 50*c*, and top and bottom walls 50*d* and 50*e*, respectively. Locking projections 50*f* (FIG. 4) are provided on the side, top and bottom wall portions for cooperation with corresponding projections 2*a* on the switch plate for connecting the cover to the switch plate with a snap connection, as shown in FIG. 5.

The switch plate 2 and the cover member 50 are provided with corresponding interlocking edges 2*a* and 50*f*, whereby when the switch plate is properly located on the switch box 6, the cover member 50 may be snapped into place. The interlocking means are so arranged as to allow easy removal of the cover member 50.

OPERATION

In operation, when the activating means 30 is depressed relative to the switch plate 2, rod portion 30*a* depresses piston 16 against the biasing force of spring 22 to the illustrated first position, and the rod portion 30*b* pivots operating member 26 in the clockwise direction to pivot switch lever 8 upwardly to the illustrated ON position. During the downward movement of the piston 16, air in the chamber 20 is forced out past the one-way seal means 18. When the actuating means 30 is released, the spring 22 biases the piston 16 upwardly causing the seal lip 18*a* to seat against the inner wall of the cylinder 14, thereby creating a vacuum within the chamber 20. The leakage of atmosphere past the seal lip 18*a* allows the piston 16 to be gradually displaced upwardly by the biasing force of the spring 22. In accordance with the rate of upward travel of the piston 16, as determined by the predetermined leakage rate of fluid into the chamber 20 via the seal lip 18*a*, the piston 16 will progressively move upwardly toward an intermediate position at which the lip portion 18*a* of the seal 18 is above the lower extremity of the axial slot 14*b* in the cylinder 14, whereupon the chamber 20 is vented to atmosphere, and the spring-biased piston 16 is rapidly displaced to its upper second position. As the piston 16 approaches its upper second position, it engages the lower extremity of the bent portion 26*c* of the operating member 26, thereby to pivot the operating member in the counterclockwise direction about the pivot shaft 24, whereby the arm 26*a* engages the switch lever 18 to pivot the same downwardly toward its OFF position. If desired, a plurality of axial slots 14*d* may be provided in the open upper end of the cylinder 14.

When the actuating means 30 has been depressed to position the piston 16 in its illustrated lowermost first or intermediate positions, it is possible to effect rapid upward travel of the piston 16 to pivot switch lever 8 downwardly to its OFF position merely by manually inserting the bleed valve stem 46 against the biasing force of spring 44 to vent the lower end of the chamber 20, whereupon the delay means afforded by the seal lip portion 18*a* is rendered inoperable.

The advantage of providing the slots 14*b* to effect rapid final travel of the piston 16 from its intermediate position to its final second position is that additional force is provided for operating the switch lever 8 of a conventional toggle type switch.

It will be apparent that actuator means having selected time delay intervals may be used as desired. Furthermore, by varying the length of the rod portion 30*d*, the time delay interval may be varied accordingly.

While in accordance with the provisions of the Patent Statutes, the preferred form and embodiment of the invention has been illustrated and described, it will be apparent to those skilled in the art that various changes and modifications may be made in the illustrated apparatus without deviating from the inventive concepts set forth above.

What is claimed is:

1. Time delay means for operating an electrical switch mounted in a switch box, said switch having an operating lever projecting from the face of said switch box and being pivotable between ON and OFF positions, comprising:

(a) a switch plate (2) adapted for mounting on the face of the switch box, said switch plate containing an aperture (10) for receiving the switch lever;

(b) a hollow cylinder (14) secured to said switch plate, one end of said cylinder being closed and the other end being open to atmosphere;

(c) a piston (16) arranged for sliding movement in said cylinder;

(d) one-way seal means (18) connected with said piston for defining a substantially fluid-tight chamber adjacent the closed end of said cylinder, said seal means comprising a flexible annular seal secured to the end of said piston remote from said closed cylinder end, said seal having a generally cup-shaped configuration with an annular circumferential lip portion in sliding engagement with the inner circumferential wall surface of said cylinder, said lip portion extending toward the open cylinder end;

(e) spring means (22) biasing said piston toward the said cylinder open end;

(f) activating means (30) for displacing said piston against the biasing force of said spring means toward a first position adjacent the closed end of the cylinder, thereby to force fluid out of said chamber via said seal means, said seal means being operable, when said piston is in the first position, to gradually leak fluid back into said chamber at a predetermined rate, whereby said piston is displaced by said spring means toward a second position adjacent the open end of said cylinder; (g) vent means for venting said chamber when said piston is in an intermediate position between said first and second positions, said vent means comprising a slot (14*b*) contained in and extending axially from the open end of said cylinder; and (h) a switch lever operating member (26) pivotally connected intermediate its ends with said switch plate for movement about a pivot axis normal to said switch plate, said operating member being adapted for engagement at one end with said lever, the other end (26*c*) of said operating member extending through said slot for engagement by said piston when said piston is adjacent said intermediate position, said operating member being pivoted by said piston from a switch-on position to a switch-off position when said piston is displaced from its intermediate position to its second position, respectively, whereby said piston travels at a given velocity from said first position to said intermediate position, and at a higher velocity from said intermediate position to said second position, thereby to quickly pivot said operating member from the switch-on position to the switch-off position.

2. Apparatus as defined in claim 1, wherein said activating means comprises a push rod assembly connected with said switch plate adjacent the open end of said cylinder for displacement axially of said cylinder, said push rod assembly including a first rod portion (30*a*) extending axially in said cylinder and terminating at one end adjacent said piston, thereby to effect depression of said piston to said first position against the biasing force of said spring means, said push rod assembly including a parallel second rod portion (30*b*) arranged externally of said cylinder for engagement with a projecting portion (26*d*) on said operating member to displace the switch lever to the ON position, when the piston is in its first position.

3. Apparatus as defined in claim 2, and further including manually operable bleed valve means (40) connected with said cylinder for venting the chamber adjacent the closed end of the cylinder, thereby to permit said spring means to cause rapid travel of said piston from the first position to the second position.

4. Apparatus as defined in claim 2, wherein said operating member one end is bifurcated to define a pair of spaced arms (26*a*, 26*b*) arranged to extend on opposite sides of the switch lever.

5. Apparatus as defined in claim 4 and further including a cover member removably connected with said switch plate to enclose said time delay means.

6. Apparatus as defined in claim 3, wherein the end of said piston adjacent the closed end of said cylinder contains a recess receiving the adjacent end of said compression spring.

* * * * *